US010208450B2

(12) United States Patent
Hauer et al.

(10) Patent No.: US 10,208,450 B2
(45) Date of Patent: Feb. 19, 2019

(54) CANTILEVER FOR A UTILITY VEHICLE

(71) Applicant: Ronald Hauer, Statzendorf (AT)

(72) Inventors: Ronald Hauer, Statzendorf (AT); Andreas Stuphann, Hofstetten (AT)

(73) Assignee: Ronald Hauer, Statzendorf (AT)

( * ) Notice: Subject to any disclaimer, the term of this patent is extended or adjusted under 35 U.S.C. 154(b) by 0 days.

(21) Appl. No.: 15/571,791

(22) PCT Filed: May 3, 2016

(86) PCT No.: PCT/AT2016/000052

§ 371 (c)(1),
(2) Date: Nov. 3, 2017

(87) PCT Pub. No.: WO2016/176699

PCT Pub. Date: Nov. 10, 2016

(65) Prior Publication Data

US 2018/0195252 A1 Jul. 12, 2018

(30) Foreign Application Priority Data

May 4, 2015 (AT) ..... 267/2015

(51) Int. Cl.
*E02F 3/38* (2006.01)
*E02F 3/34* (2006.01)
(Continued)

(52) U.S. Cl.
CPC ..... *E02F 3/38* (2013.01); *E02F 3/283* (2013.01); *E02F 3/3411* (2013.01);
(Continued)

(58) Field of Classification Search
CPC . E02F 9/2271; E02F 3/38; E02F 3/283; E02F 3/3417; E02F 3/3677; E02F 3/3695
See application file for complete search history.

(56) References Cited

U.S. PATENT DOCUMENTS 2,645,369 A * 7/1953 Allan ..... E02F 3/3405 414/713
3,722,724 A * 3/1973 Blakely ..... E02F 3/283 414/697

(Continued)

FOREIGN PATENT DOCUMENTS

DE 12 30 359 B 12/1966
DE 100 47 210 A1 4/2002

(Continued)

OTHER PUBLICATIONS

International Search Report issued in Application No. PCT/AT2016/000052, dated Sep. 2, 2006.

*Primary Examiner* — Gerald McClain
(74) *Attorney, Agent, or Firm* — Young & Thompson

(57) ABSTRACT

A cantilever includes a spar connected rotatably about a rear fixed axis to a fastening device for a vehicle, a tool lever connected rotatably about a front fixed axis to the spar, a deflecting triangle connected rotatably about a central fixed axis to the spar, a rear strut connected rotatably about a first strut pivot axis to the fastening device and rotatably about a second strut pivot axis to the deflecting triangle, a front strut connected rotatably about a third strut pivot axis to the deflecting triangle and rotatably about a fourth strut pivot axis to the tool lever. The rear and the central fixed axis span a first plane. The rear strut intersects the first plane. The central and the front fixed axis span a second plane. The front strut intersects the second plane.

11 Claims, 2 Drawing Sheets

(51) Int. Cl.

| | |
|---|---|
| ***E02F 3/43*** | (2006.01) |
| ***E02F 3/627*** | (2006.01) |
| ***E02F 3/28*** | (2006.01) |
| ***E02F 3/36*** | (2006.01) |
| ***E02F 9/22*** | (2006.01) |

(52) U.S. Cl.

CPC ..... *E02F 3/3417* (2013.01); *E02F 3/3677* (2013.01); *E02F 3/3695* (2013.01); *E02F 3/433* (2013.01); *E02F 3/627* (2013.01); *E02F 9/2271* (2013.01)

(56) References Cited

U.S. PATENT DOCUMENTS

| | | | | |
|---|---|---|---|---|
| 5,688,101 | A | 11/1997 | Kim | |
| 9,783,962 | B1 * | 10/2017 | Hitchcock | E02F 9/264 |
| 2005/0241193 | A1 | 11/2005 | Burgin | |

FOREIGN PATENT DOCUMENTS

| | | | | |
|---|---|---|---|---|
| EP | 1 903 147 | A2 | 3/2008 | |
| JP | 61102920 | A * | 5/1986 | E02F 3/38 |

* cited by examiner

CANTILEVER FOR A UTILITY VEHICLE

The invention relates to a cantilever, in particular for a utility vehicle,

Whereby a spar is connected so as to rotate around a rear fixed axis with a fastening device for a vehicle, Whereby a tool lever is connected so as to rotate around a front fixed axis with the spar, Whereby a deflecting triangle is connected so as to rotate around a central fixed axis with the spar, Whereby a rear strut is connected so as to rotate around a first strut pivot axis with the fastening device and so as to rotate around a second strut pivot axis with the deflecting triangle, And whereby a front strut is connected so as to rotate around a third strut pivot axis with the deflecting triangle and so as to rotate around a fourth strut pivot axis with the tool lever.

Such cantilevers that are usually embodied as parallel guides are known from, for example, EP 1 903 147 A. In general, two such cantilevers are mounted on a vehicle beside one another and connected to one another, and they move a tool that is fastened to the cantilevers. In addition to a control that is as accurate as possible, in this case there are additional aims to improve such cantilevers. On the one hand, the field of view of an operator is to be limited as little as possible; on the other hand, the cantilever is to be able to be operated as safely as possible. Both can be achieved in that as many elements of the cantilever as possible are concealed under a lining. Thus, fouling of the movable parts of the cantilever leading to wear can be reduced. In addition, many movable parts, which otherwise represent a potential risk of injury, are no longer easily accessible. However, in the case of a conventional arrangement of the elements of a parallel guide, the lining occupies a large part of the field of view of an operator, which greatly limits comfort during operation, on the one hand, and creates a new safety risk, on the other hand, since the operator can no longer survey his environs.

EP 1 903 147 A supplies a proposed solution to make the cantilever more slender and thus to give the operator a better field of view. In this case, a strut of the cantilever is bent in such a way that the central area of the strut is offset further into the spar for the most part. This has the drawback, however, that the strut, which has buckling points or a curvature created by this shape, loses stability. This has to be offset by making the strut more massive, which both makes production more expensive and produces a higher weight.

The object of the invention is therefore to overcome the above-described drawbacks and to make available a compact—and in this case sturdy and economical—option for cantilevers of the above-mentioned type.

This object is achieved according to the invention by a cantilever of the above-mentioned type, which is characterized in that The rear and the central fixed axes span a first plane and in that the rear strut intersects the first plane, In that the central and the front fixed axes span a second plane and in that the front strut intersects the second plane.

Because of this non-parallel, but "crosswise," arrangement, much more space can be saved, whereby the rear strut winds up bent to a much lesser extent. In this case, the spar acts simultaneously as a lining and a carrier for the fixed axes. Thus, only the struts that pivot around movable axes are necessary.

This saves space and simultaneously eliminates the necessity for a parallel arrangement. In a preferred embodiment, the struts are therefore arranged essentially inside the spar.

In a preferred further development of the invention, the front strut has a tool drive, by which the length of the strut can be changed in order to move the tool lever. Of course, embodiments without a tool drive are also conceivable. In this case, the tool, as known from parallel guides, is moved. In another preferred embodiment of the invention, a tool guide that can be connected with a tool is arranged for the movement on the tool lever.

In order to configure the tool lever and the associated tool guide in an easily accessible manner, the tool lever—in another preferred embodiment—is arranged essentially half outside and half inside the spar.

In the state of the art, in the case of cantilevers that have a sharp bend, the deflecting triangle is arranged oriented in the area of the sharp bend and with the (central) fixed axis on the outside of the sharp bend. In an especially preferred embodiment of the invention, the crossing is created in such a way that the deflecting triangle is arranged inversely. Consequently, in an especially preferred embodiment of the invention, the spar has a sharp bend, the central fixed axis of the deflecting triangle is arranged in the area of the inside of the sharp bend, and the second and third strut pivot axes are arranged at some distance therefrom.

Additional preferred embodiments of the invention are the subject matter of the other subclaims.

Below, a preferred embodiment of the invention is described in more detail based on the drawings. Here:

Figure 1:
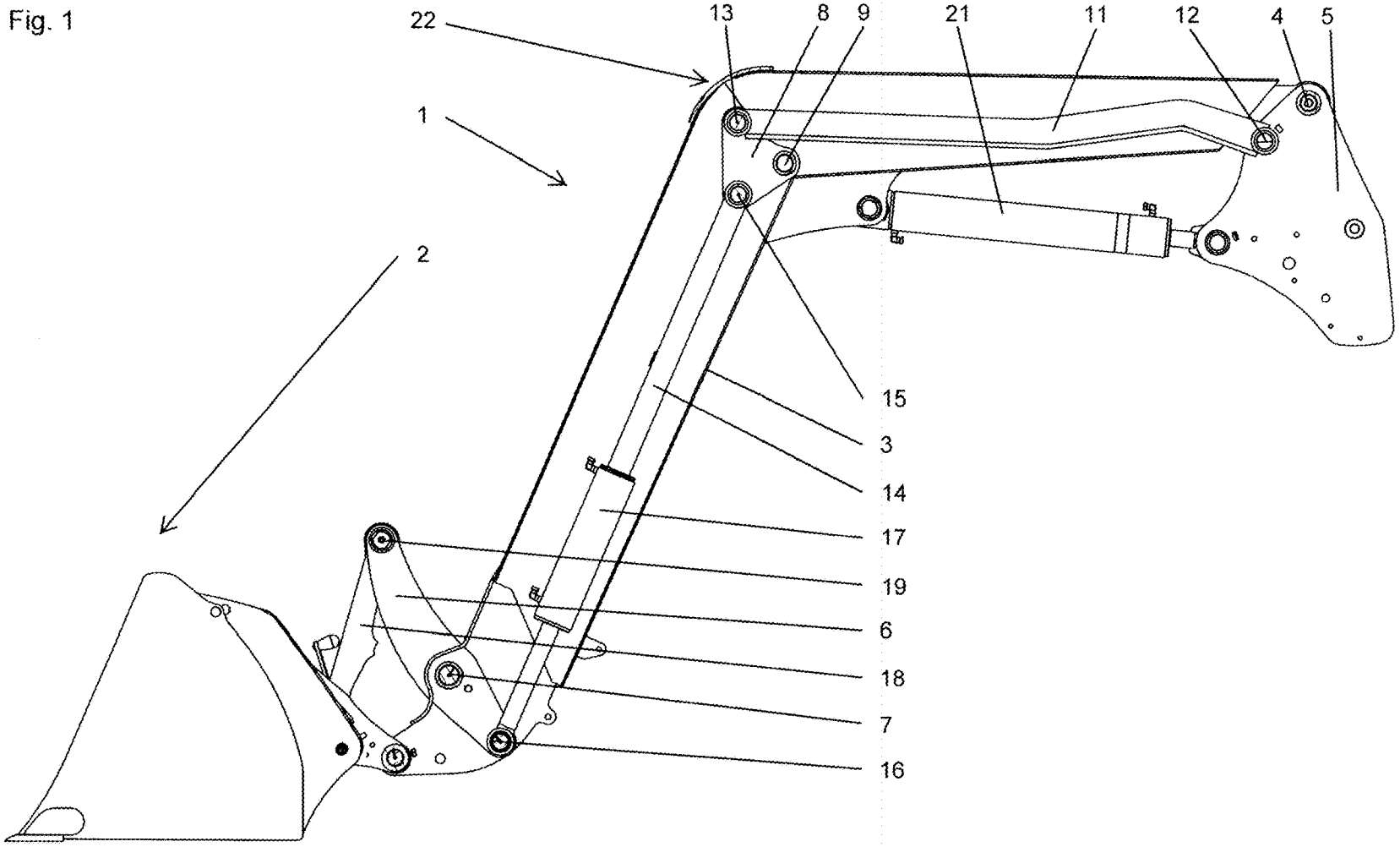
FIG. 1 shows a section through a cantilever 1 with a tool 2.

The cantilever 1 shown in FIG. 1 with a tool 2 has a spar 3, which is used both as a carrier for various elements of the cantilever and as a lining of the cantilever. The spar 3 is connected so as to rotate around a rear fixed axis 4 with a fastening device 5. With the fastening device 5, the cantilever 1 can be fastened to a vehicle. Of course, embodiments are also conceivable in which the fastening device 5 is a more integral component of the utility vehicle. At the other end of the spar 3, a tool lever 6 is connected so as to rotate around a front fixed axis 7 with the spar 3. In a central area of the spar 3, a deflecting triangle 8 is arranged. The deflecting triangle 8 is connected so as to rotate around a central fixed axis 9 with the spar 3. A rear strut 11 is connected so as to rotate around a first strut pivot axis 12 with the fastening device 5 and so as to rotate around a second strut pivot axis 13 with the deflecting triangle 8. A front strut 14 is connected so as to rotate around a third strut pivot axis 15 with the deflecting triangle 8 and so as to rotate around a fourth strut pivot axis 16 with the tool lever 6. In the depicted embodiment, the front strut 14 has a tool drive 17, via which the length of the front strut 14 can be changed. Thus, the position of the tool 2 can be changed via the tool lever 6. In the depicted embodiment, in this connection, a tool guide 18 is connected so as to rotate around a guide pivot axis 19 with the tool lever 6. In order to move the spar 3 relative to the vehicle or the fastening device 5, a lifting drive 21 is provided.

It is clear that the rear fixed axis 4 in the depicted orientation of the cantilever 1 lies above the first strut pivot axis 12, and the central fixed axis 9 lies below the second strut pivot axis 13. This is accomplished in that the deflecting triangle 8, unlike in the state of the art, is arranged inversely in the spar 3. The deflecting triangle 8 is thus located specifically in the area of a sharp bend 22 of the spar 3, as is common in the state of the art. However, the central fixed axis of the deflecting triangle 8 is arranged in the area of an inner side of the sharp bend 22.

Figure 2:
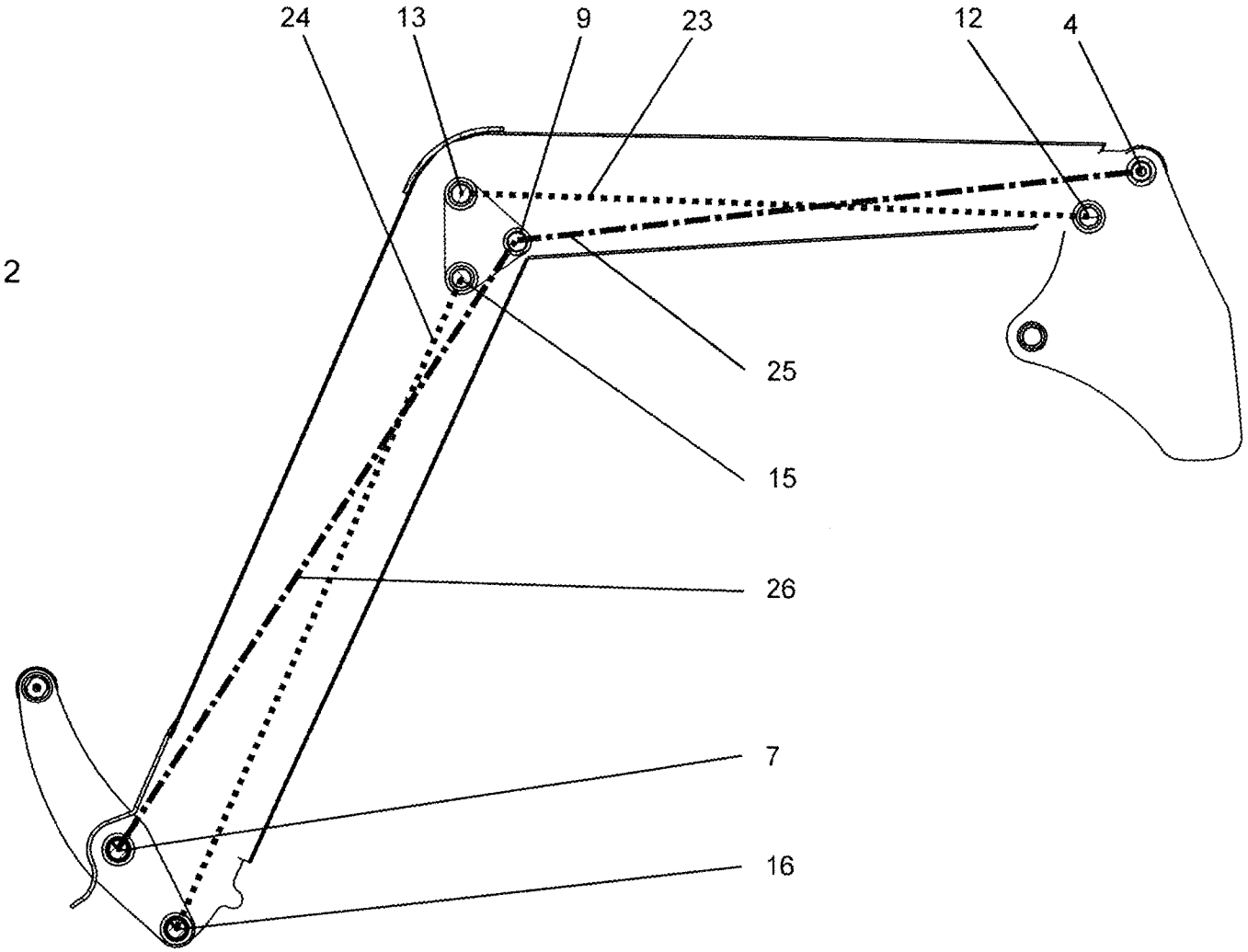
FIG. 2 shows the cantilever with connecting lines and longitudinal axes depicting the invention in schematized form.

The basic crosswise arrangement of the struts according to the invention is illustrated in more detail in FIG. 2 with reference to the fixed axes. Longitudinal axes of the struts 11, 14, depicted symbolically in each case by dotted lines 23, 24, are shown by the rear and front struts 11, 14. In addition, dashed-dotted connecting lines 25, 26 are indicated between the fixed axes 4, 7, 9. In this case, a rear dashed-dotted connecting line 25 symbolically shows a first plane that is spanned by the rear fixed axis 4 and the central fixed axis 9. A front dashed-dotted line 26 symbolically shows a second plane that is spanned by the central fixed axis 9 and the front fixed axis 7.

It is clear that the rear strut 11 that is depicted by the rear dotted line 23 intersects the first plane and that the front strut 14, which is symbolically depicted by the front dotted line 24, intersects the second plane.

The invention claimed is:

1. A cantilever (1), for a vehicle, the cantilever comprising:

a fastening device (5) that fastens the cantilever to the vehicle, the fastening device including a rear fixed axis (4) and a first strut pivot axis (12);

a spar (3) having a front end and a rear end, the rear end of the spar being connected so as to rotate around the rear fixed axis (4) with the fastening device (5), the spar having a sharp bend (22) located between the front end and the rear end, the sharp bend (22) having an inner side and an outer side, the front end of the spar including a front fixed axis (7);

a deflecting triangle (8) located in an area of the sharp bend (22), the deflecting triangle (8) including a central fixed axis (9), a second strut pivot axis (13), and a third strut pivot axis (15), the deflecting triangle (8) being connected so as to rotate around the central fixed axis (9) with the spar (3);

a tool lever (6) connected so as to rotate around the front fixed axis (7) with the spar (3), the tool lever (6) including a fourth strut pivot axis (16);

a rear strut (11) connected so as to rotate around the first strut pivot axis (12) with the fastening device (5) and so as to rotate around the second strut pivot axis (13) with the deflecting triangle (8); and a front strut (14) connected so as to rotate around the third strut pivot axis (15) with the deflecting triangle (8) and so as to rotate around the fourth strut pivot axis (16) with the tool lever (6), wherein the rear fixed axis (4) and the central fixed axis (9) span a first plane, wherein the rear strut (11) intersects the first plane, wherein the central fixed axis (9) and the front fixed axis (7) span a second plane, wherein the front strut (14) intersects the second plane, wherein the central fixed axis (9) is arranged at a first distance from the inner side of the sharp bend (22), wherein the second strut pivot axis (13) is at a second distance from the inner side of the sharp bend (22), the third strut pivot axis (15) is arranged at a third distance from the inner side of the sharp bend (22), wherein the first distance is less than the second distance and the first distance is less than the third distance so that the second and third strut pivot axes (13, 15) are arranged at a greater distance from the inner side of the sharp bend than the first distance at which the central fixed axis (9) is arranged from the inner side of the sharp bend, and wherein the rear and front struts (11, 14) are arranged entirely inside the spar (3).

2. The cantilever (1) according to claim 1, wherein a tool guide (18) is arranged on the tool lever (6).

3. A vehicle comprising at least one cantilever (1) according to claim 1.

4. The cantilever (1) according to claim 1, wherein the deflecting triangle (8) is arranged inside the spar (3).

5. The cantilever (1) according to claim 1, wherein the tool lever (6) is arranged essentially half outside and half inside the spar (3).

6. The cantilever (1) according to claim 1, wherein the front strut (14) has a tool drive (17), and operation of the tool drive (17) changes a length of the front strut (14).

7. A cantilever (1), for a vehicle, the cantilever comprising:

a fastening device (5) that fastens the cantilever to the vehicle, the fastening device including a rear fixed axis (4) and a first strut pivot axis (12);

a spar (3) having a front end and a rear end, the rear end of the spar being connected so as to rotate around the rear fixed axis (4) with the fastening device (5), the spar having a sharp bend (22) located between the front end and the rear end, the sharp bend (22) having an inner side and an outer side, the front end of the spar including a front fixed axis (7);

a deflecting triangle (8) located in an area of the sharp bend (22), the deflecting triangle (8) including a central fixed axis (9), a second strut pivot axis (13), and a third strut pivot axis (15), the deflecting triangle (8) being connected so as to rotate around the central fixed axis (9) with the spar (3);

a tool lever (6) connected so as to rotate around the front fixed axis (7) with the spar (3), the tool lever (6) including a fourth strut pivot axis (16);

a rear strut (11) connected so as to rotate around the first strut pivot axis (12) with the fastening device (5) and so as to rotate around the second strut pivot axis (13) with the deflecting triangle (8); and a front strut (14) connected so as to rotate around the third strut pivot axis (15) with the deflecting triangle (8) and so as to rotate around the fourth strut pivot axis (16) with the tool lever (6), wherein the rear fixed axis (4) and the central fixed axis (9) span a first plane, wherein the rear strut (11) intersects the first plane, wherein the central fixed axis (9) and the front fixed axis (7) span a second plane, wherein the front strut (14) intersects the second plane, wherein the central fixed axis (9) is arranged at a first distance from the inner side of the sharp bend (22), wherein the second strut pivot axis (13) is at a second distance from the inner side of the sharp bend (22), the third strut pivot axis (15) is arranged at a third distance from the inner side of the sharp bend (22), and wherein the first distance is less than the second distance and the first distance is less than the third distance so that the second and third strut pivot axes (13, 15) are arranged at a greater distance from the inner side of the sharp bend than the first distance at which the central fixed axis (9) is arranged from the inner side of the sharp bend, wherein the deflecting triangle (8) is arranged entirely inside the spar (3).

8. The cantilever (1) according to claim 7, wherein the tool lever (6) is arranged essentially half outside and half inside the spar (3).

9. The cantilever (1) according to claim 7, wherein the front strut (14) has a tool drive (17), and operation of the tool drive (17) changes a length of the front strut (14).

10. A vehicle comprising at least one cantilever (1) according to claim 7.

11. The cantilever (1) according to claim 7, wherein the rear and front struts (11, 14) are arranged essentially inside the spar (3).

* * * * *